US006942466B2

(12) United States Patent
Ransom et al.

(10) Patent No.: US 6,942,466 B2
(45) Date of Patent: Sep. 13, 2005

(54) MECHANICAL PUMPS

(75) Inventors: Kevin Michael Ransom, Worthing (GB); Clifford Palmer, Horsham (GB)

(73) Assignee: The BOC Group plc, Windlesham (GB)

( * ) Notice: Subject to any disclaimer, the term of this patent is extended or adjusted under 35 U.S.C. 154(b) by 39 days.

(21) Appl. No.: 10/262,688

(22) Filed: Oct. 2, 2002

(65) Prior Publication Data

US 2003/0086795 A1 May 8, 2003

(30) Foreign Application Priority Data

Oct. 4, 2001 (GB) ..... 0123873

(51) Int. Cl.[7] ..... F04B 39/00
(52) U.S. Cl. ..... 417/312; 417/572
(58) Field of Search ..... 417/312, 313, 417/315, 321, 423.14, 481, 479, 572, 410.1, 410.3, 422, 423.1; 48/190, 191, 192; 431/344, 345, 346, 350, 351

(56) References Cited

U.S. PATENT DOCUMENTS 3,338,223 A * 8/1967 Williams ..... 123/522
3,496,538 A * 2/1970 Christiaan Johannes Van Dalen ..... 714/748
3,535,066 A * 10/1970 Wagner ..... 431/346
4,975,098 A * 12/1990 Lee et al. ..... 48/192
5,156,536 A * 10/1992 Wilson ..... 417/572
5,344,313 A * 9/1994 Johnsen, Jr. ..... 431/346
5,752,812 A 5/1998 Brown

FOREIGN PATENT DOCUMENTS

| | | | | |
|---|---|---|---|---|
| EP | 549086 A1 | * | 6/1993 | ..... F04B/21/00 |
| EP | 0 549 086 A1 | | 6/1993 | |
| EP | WO-97/32130 | * | 9/1997 | ..... F04C/11/00 |
| GB | 562 907 | | 7/1944 | |
| GB | 565 271 | | 11/1944 | |
| GB | 834 689 | | 5/1960 | |

OTHER PUBLICATIONS

UK Patent Office Search Report dated Mar. 15, 2002.

* cited by examiner

*Primary Examiner*—Charles G. Freay
(74) *Attorney, Agent, or Firm*—Ira Lee Zebrak

(57) ABSTRACT

A mechanical pump having an inlet and spaced therefrom an outlet for the passage of fluid therethrough and incorporating at least one flame arrester.

11 Claims, 2 Drawing Sheets

MECHANICAL PUMPS

FIELD OF THE INVENTION

The present invention relates to mechanical pumps, and in particular, to mechanical pumps for use in the chemical and process industries where there are inherent risks of explosions and /or fires due to the properties of the fluids to be pumped.

BACKGROUND OF THE INVENTION

Currently commercial flame arresters are separate costly devices which are bolted or otherwise fitted to mechanical pumps to mitigate against or inhibit the chances of an explosion or a fire arising from the pumping of hazardous fluids. These known flame arresters are made from expensive stainless steel since they are conceived as 'cold pipework' and are susceptible to corrosion. They also require considerable mechanical support.

SUMMARY OF THE INVENTION

It is an aim of the present invention to provide a mechanical pump which incorporates at least one flame arrester.

By effectively integrating the flame arrester within the mechanical pump, the flame arrester is kept hotter and less susceptible to corrosion. Furthermore, the flame arrester can safely be made from a cheaper material than stainless steel, for example spheriodal graphite iron.

According to the present invention, a mechanical pump having an inlet and spaced therefrom an outlet for the passage of fluid therethrough incorporates at least one flame arrester.

Preferably, the flame arrester is located immediately adjacent the pump inlet.

In one embodiment, two flame arresters are incorporated in the pump, one being located immediately adjacent the pump inlet and the second being located immediately adjacent the pump outlet.

The or each flame arrester may include a flame arresting element removably mounted within a housing. This feature allows for the flame arresting element to be removed or replaced without disturbing any process pipework to which the pump is attached.

The housing may have a rectangular box section body the opposite ends of which are closed by one or more removable cover plates which facilitates the removal of the flame arresting element.

BRIEF DESCRIPTION OF THE DRAWINGS

An embodiment of the invention will now be described, by way of example, reference being made to the Figures of the accompanying diagrammatic drawings in which.

DETAILED DESCRIPTION OF THE INVENTION

Figure 1:
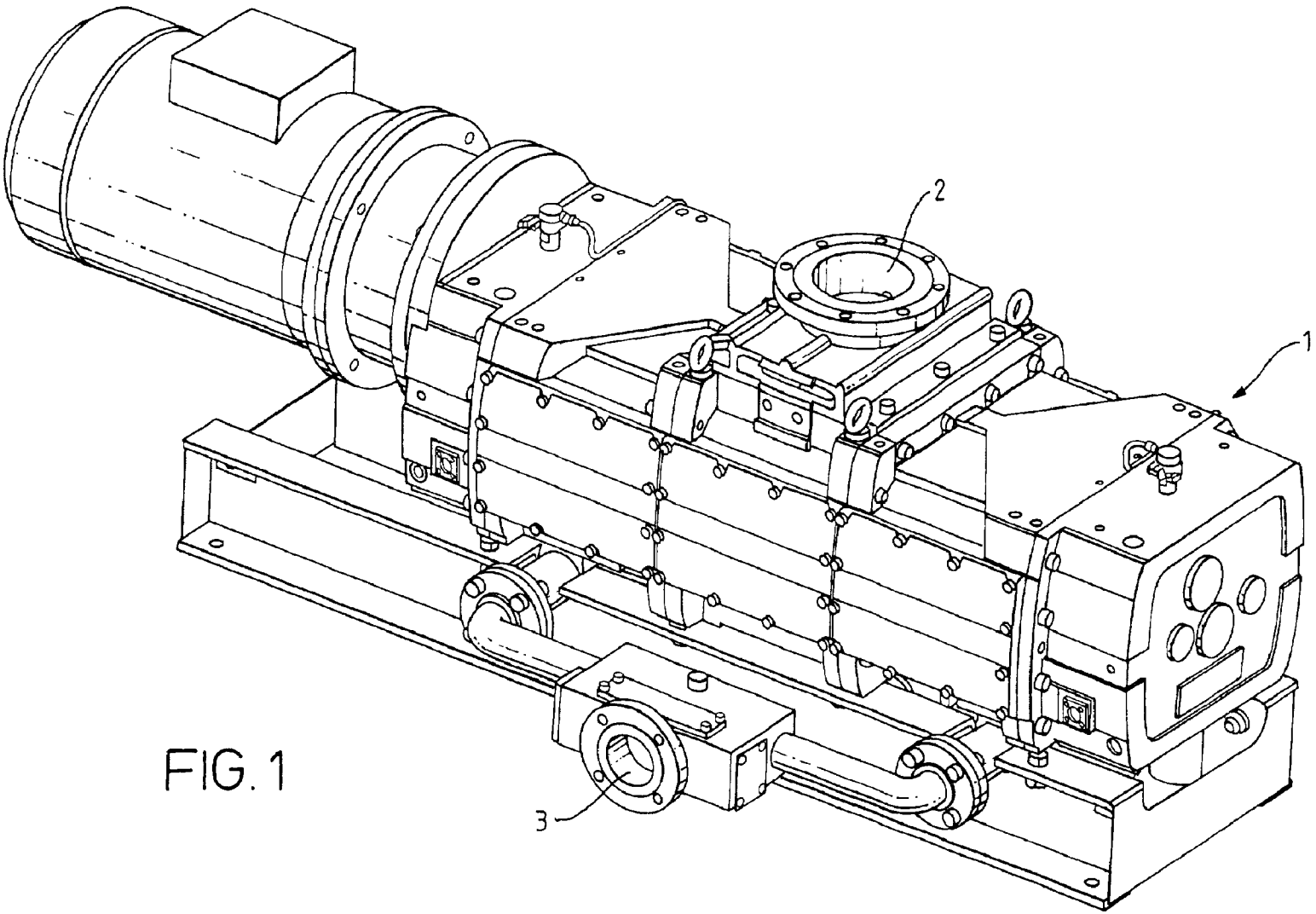
FIG. 1 is a perspective view of a mechanical pump according to the present invention.
Figure 2:
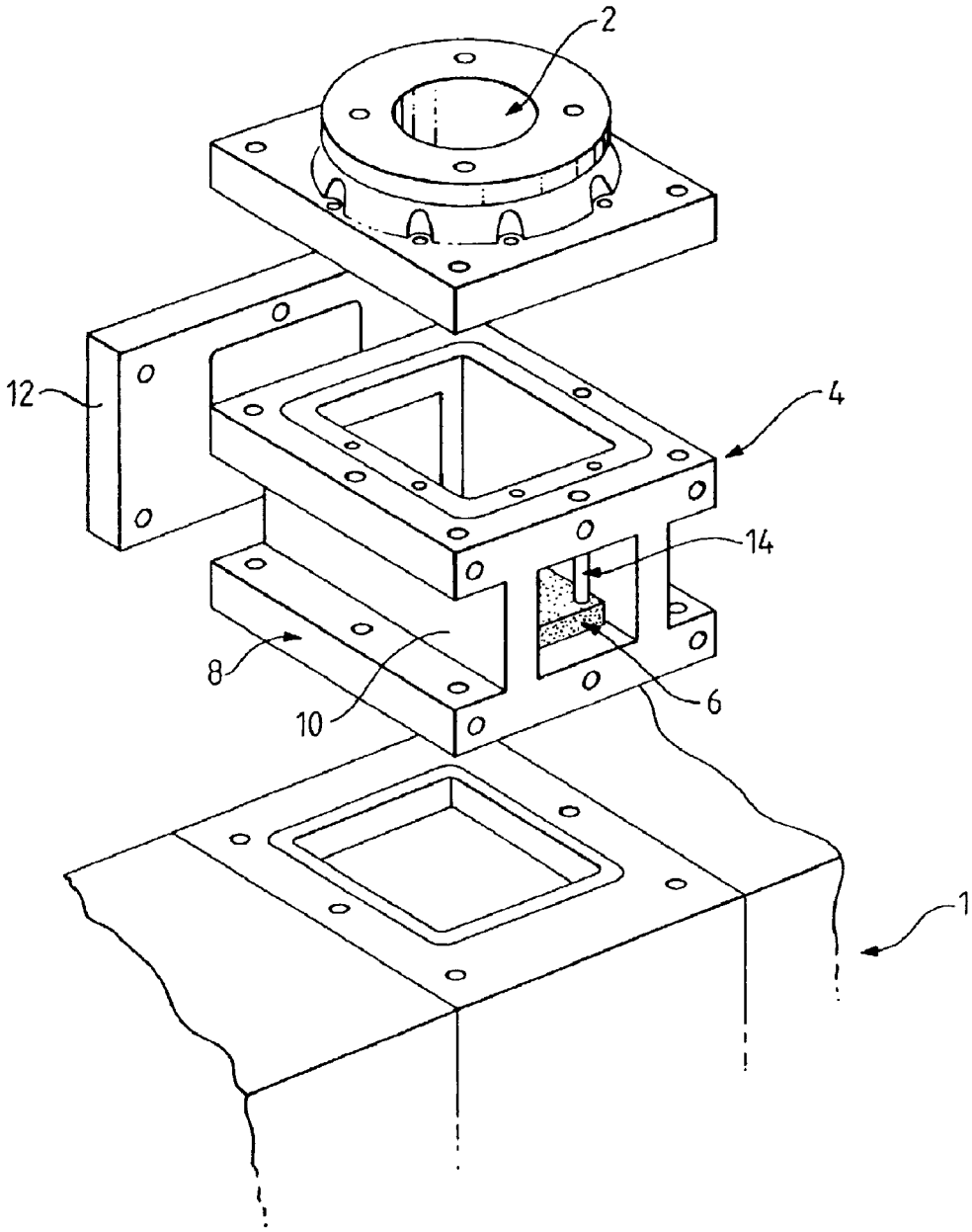
FIG. 2 is an exploded detail of the mechanical pump of FIG. 1 illustrating a flame arrester incorporated within the pump.

Referring to the figures, a mechanical pump 1 includes an inlet 2 and an outlet 3 spaced from the inlet 2 for the passage therethrough of a fluid to be pumped.

Immediately adjacent the inlet 2 there is located a flame arrester 4 which includes a flame arresting element 6 made, for example, from mesh material, removably mounted within a housing 8. The housing 8 has a rectangular box section body 10 opposite ends of which are closed by removable cover plates 12 (only one shown). Since the body 10 and cover plates 12 form part of the pump 1 and attain high temperatures when the pump 10 is running they can be made from relatively cheap material such as grey or spheriodal graphite iron without the risk of corrosion.

In use, with one or both cover plates 12 removed, the flame arresting element 6 is slid in place within the body 10 of the housing 8. The or each cover plate 12 is then bolted to its respective end face of the body 10 to seal the flame arresting element within the housing 8.

Finally, the flame arresting element 6 is clamped in place by for example a plurality of bolts 14 or other mechanical means in the housing 8. The bolts 14 are sealed within the housing to make them leak-tight.

The flame arrester 4 is bolted to the pump casing between the casing and the pump inlet 2 and is thereby incorporated within the body of the pump 1.

It will be apparent that the flame arresting element 6 can be removed from the pump 1 for cleaning or replacement by removing one of the cover plates 12, releasing the bolts 14, and sliding the flame arresting element 6 out from the body 10 of the housing 8.

In this manner, the flame arresting element 6 can be removed without disturbing any process pipework to which the pump 1 is attached.

It will be evident that a second flame arrester can be incorporated within the pump 1 immediately adjacent the outlet 3 of the pump in a similar manner to that described with respect to flame arrester 4 and the pump inlet 2.

Although the housing 8 is described and shown having a rectangular box section body 10, other shapes could be used, for example oval or circular.

While the present invention has been particularly shown and described with reference to the preferred embodiments thereof, it will be apparent to by those skilled in the art that various changes in form and details may be made therein without departing from the spirit and scope of the invention.

What is claimed is:

1. A mechanical pump having an inlet and spaced therefrom an outlet for the passage of fluid therethough and incorporating at least one flame arrester including a flame arresting element removably mounted within a housing having a rectangular box section body opposite ends of which are closed by removable cover plates.

2. A mechanical pump as claimed in claim 1 in which the housing is made from spheroidal graphite iron.

3. A mechanical pump having an inlet and spaced therefrom an outlet for the passage of fluid therethough and wherein two flame arresters are incorporated in the pump, one being located immediately adjacent the pump inlet and the second being immediately adjacent the pump outlet, wherein each flame arrester includes a flame arresting element made from a mesh material and removably mounted within a housing having a rectangular box section body opposite ends of which are closed by removable cover plates.

4. A mechanical pump as claimed in claim 3 in which the housing is made from spheroidal graphite iron.

5. A mechanical pump having an inlet and spaced therefrom an outlet for the passage of fluid therethough and wherein two flame arresters are incorporated within the pump, one being located immediately adjacent the pump inlet and the second being immediately adjacent the pump outlet, each flame arrester including a flame arresting element removably mounted within a housing having a rectangular box section body opposite ends of which are closed by removable cover plates.

6. A mechanical pump having an inlet and spaced therefrom an outlet for the passage of fluid therethrough and incorporating at least one flame arrester including a flame arresting element removably mounted within a housing having a rectangular box section body opposite ends of which are closed by removable cover plates, and in which said at least one flame arrester is located immediately adjacent the pump inlet.

7. A mechanical pump as claimed in claim 6 in which the housing is made from spheroidal graphite iron.

8. A mechanical pump having an inlet and spaced therefrom an outlet for the passage of fluid therethough and incorporating at least one flame arrester located immediately adjacent the pump inlet, and including a flame arresting element made from a mesh material removably mounted within a housing having a rectangular box section body opposite ends of which are closed by removable cover plates.

9. A mechanical pump as claimed in claim 8 in which the housing is made from spheroidal graphite iron.

10. A mechanical pump comprising:

a pump body having an inlet and a casing;

at least one flame arrester wherein the at least one flame arrester is within the pump body between the inlet and the casing an includes a flame arresting element removably mounted within a housing adapted to form a access to the flame arresting element; and a plate for attachment to the housing for covering the access.

11. A mechanical pump comprising:

a pump body having an inlet and a casing;

two flame arresters are within the pump body, a first flame arrester between the inlet and the casing and a second flame arrester between the outlet and the casing;

at least one of the first flame arrester and the second flame arrester includes a flame arresting element removably mounted within a housing adapted to form an access to the flame arresting element; and a plate for attachment to the housing for covering the access.

* * * * *